US008525734B2

(12) United States Patent
Krogerus

(10) Patent No.: US 8,525,734 B2
(45) Date of Patent: Sep. 3, 2013

(54) ANTENNA DEVICE

(75) Inventor: Joonas Veli-Allan Krogerus, Espoo (FI)

(73) Assignee: Nokia Corporation, Espoo (FI)

( * ) Notice: Subject to any disclaimer, the term of this patent is extended or adjusted under 35 U.S.C. 154(b) by 766 days.

(21) Appl. No.: 12/520,719

(22) PCT Filed: Dec. 21, 2006

(86) PCT No.: PCT/IB2006/004186

§ 371 (c)(1),
(2), (4) Date: Feb. 26, 2010

(87) PCT Pub. No.: WO2008/084273

PCT Pub. Date: Jul. 17, 2008

(65) Prior Publication Data

US 2010/0214180 A1 Aug. 26, 2010

(51) Int. Cl.
*H01Q 1/24* (2006.01)

(52) U.S. Cl.
USPC ..... 343/702; 343/745

(58) Field of Classification Search
USPC ..... 343/700, 702, 745, 749, 846
See application file for complete search history.

(56) References Cited

U.S. PATENT DOCUMENTS 5,559,521 A 9/1996 Evans et al.
5,668,561 A * 9/1997 Perrotta et al. ..... 343/702
5,986,608 A * 11/1999 Korisch et al. ..... 343/702
6,504,507 B2 * 1/2003 Geeraert ..... 343/700 MS
6,624,789 B1 9/2003 Kangasvieri et al.
2003/0050032 A1 * 3/2003 Masaki ..... 455/272
2003/0151555 A1 8/2003 Holshouser
2006/0262026 A1 11/2006 Gainey et al.
2008/0252536 A1 * 10/2008 Anguera et al. ..... 343/702

FOREIGN PATENT DOCUMENTS

EP 0716470 A 6/1996
EP 1052723 A 11/2000
EP 1278155 A 1/2003
EP 1294048 A 3/2003
JP 10261914 A 9/1998

OTHER PUBLICATIONS

Skrivervik, "Terminal Antennas : Developments and Trends", Ecole Polytechnique Fédérale de Lausanne, Feb. 2004.
Vainikainen et al., "Resonator-based analysis of the combination of mobile handset antenna and chassis", IEEE Trans. on Ant. and Prop., vol. 50, No. 10, pp. 1433-1444, Oct. 2002.
Kivekas et al., "Bandwidth, SAR, and efficiency of internal mobile phone antennas", IEEE Trans. on EMC, vol. 46, No. 1, Feb. 2004 pp. 71-86.
Lindberg et al., "A Bandwidth Enhancement Technique for Mobile Handset Antennas Using Wavetraps", IEEE Trans. on Ant. and Prop., vol. 54, No. 8, Aug. 2006, pp. 2226-2233.

* cited by examiner

*Primary Examiner* — Tho G Phan
(74) *Attorney, Agent, or Firm* — Nokia Corporation

(57) ABSTRACT

An antenna device for a portable electronic device and an electronic device provided with such an antenna are disclosed. The antenna device is configured to provide in a combination a tuning element for tuning at least one electrical dimension of the portable electronic device and an antenna radiator element of the portable electronic device.

20 Claims, 13 Drawing Sheets

ANTENNA DEVICE

RELATED APPLICATION

Figure 1:
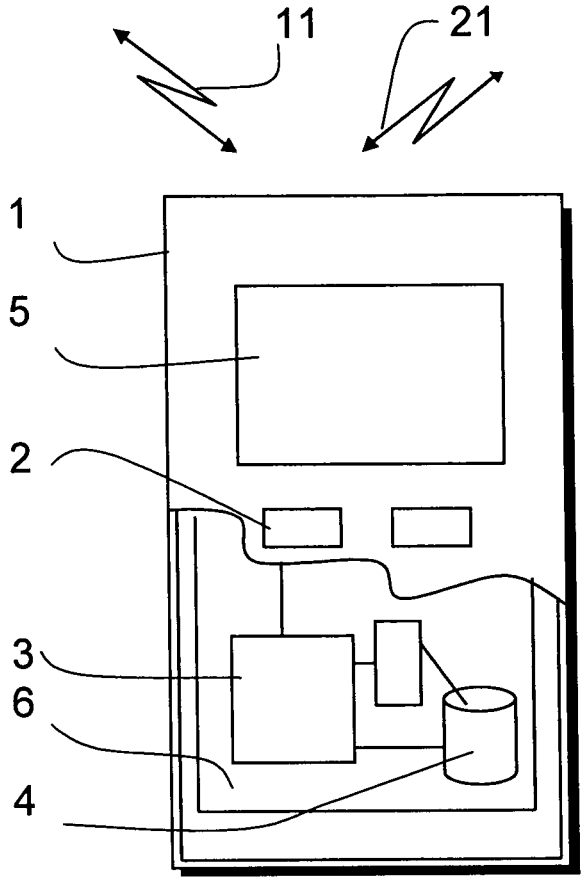

This application was originally filed as and claims priority to PCT Application No. PCT/IB2006/004186 filed 21 Dec. 2006.

The present invention relates to an antenna device and in particular to an antenna device configuration for a wireless communications device.

A communication device can be understood as a device provided with appropriate communication and control capabilities for enabling use thereof for communication with others parties. The communication may comprise, for example, communication of voice, electronic mail (email), text messages, data, multimedia and so on. A communication device typically enables a user of the device to receive and transmit communication via a communication system and can thus be used for accessing various applications.

A communication system is a facility which facilitates the communication between two or more entities such as the communication devices, network entities and other nodes. An appropriate access system allows the communication device to access to the communication system. An access to the communications system may be provided by means of a fixed line or wireless communication interface, or a combination of these.

Communication systems providing wireless access typically enable at least some mobility for the users thereof. Examples of these include cellular wireless communications systems where the access is provided by means of access entities called cells. Other examples of wireless access technologies include different wireless local area networks (WLANs) and satellite based communication systems.

A typical feature of the modern mobile communication devices is that they are portable, usually small enough to be pocket sized. A modern portable communication device, for example a mobile phone, is already relatively small in size, but the market is demanding ever smaller portable devices.

A wireless communication system typically operates in accordance with a wireless standard and/or with a set of specifications which set out various aspects of the wireless interface. For example, the standard or specification may define if the user, or more precisely user equipment, is provided with a circuit switched bearer or a packet switched bearer, or both. Communication protocols and/or parameters which should be used for the wireless connection are also typically defined. For example, the frequency band or bands to be used for the communications are typically defined.

A portable communication device may be provided with so called multi-radio capabilities. That is, a portable device may be used for communication via a plurality of different wireless interfaces. An example of such device is a multi-mode cellular phone, for example a cellular phone that may communicate in at least two of the GSM (Global System for Mobile) frequency bands 850, 900, 1800 and 1900 MHz or a cellular phone that may communicate based on at least two different standards, say the GSM and a CDMA (Code Division Multiple Access) and/or WCDMA (Wideband CDMA) based systems such as the UMTS (Universal Mobile Telecommunications System). A mobile or portable device may also be configured for communication via at least one cellular system and at least one non-cellular system. Non-limiting examples of the latter include short range radio links such as the Bluetooth™, various wireless local area networks (WLAN), local systems based on the Digital Video Broadcasting via Handheld Terminals (DVB-H) and ultra wide band (UWB) and so on.

Since the multi-radio devices communicate over a plurality of different frequency bands, a single antenna may not always be best suited for all of the frequencies. Several antennas operating in different frequency bands may thus be needed in a multi-radio antenna system. Regardless the number, each of the antennas should provide a good performance. This might be required in particular when small mobile devices are concerned. The size of terminals is shrinking at the same time as new services and radio systems are introduced. As a consequence, a need exists for making the individual antennas even smaller and minimizing the total volume required by the entire multi-radio antenna system of the device.

The metallic chassis, printed wiring board or another element that provides what is known as the ground plane of a portable device or terminal has also a role in antenna characteristics of the device. At frequencies below 1 GHz the chassis usually provides the major radiating element. The chassis also has a role in frequencies above 1 GHz, although usually to a lesser extent.

The chassis and/or printed wiring board (PWB) dimensions and geometry dictate the resonance frequencies of the resonance modes of the mobile device. From the impedance bandwidth (BW) point of view, optimal operating conditions may be achieved when the resonant frequency of the chassis is substantially close to the resonant frequency of the antenna element.

The joint impedance bandwidth of an antenna and a chassis depends on what is known as the effective electrical length of the chassis. A maximum bandwidth can typically be obtained when the effective length of the chassis is a multiple of approximately $0.5\lambda_0$ at the operating frequency.

In a typical portable device the physical length of the chassis is non-optimal when considering the operation of antennas, both cellular and non-cellular. For example, in a monoblock design the chassis may be too short for a particular frequency band. In a foldable or otherwise extendable design the chassis may be too long, again depending on the frequency band.

Recently, some techniques have been introduced for controlling the electrical dimensions of a chassis, such as the length and/or width of the chassis to achieve a more optimal exploitation of the chassis resonance modes. Terminal antenna performance can be significantly improved by better exploitation of the chassis resonance modes. For example, the bandwidth can be increased by tuning the chassis resonance modes more optimally by advanced design of the chassis. Instead of increasing the bandwidth, the dimensions of an antenna element can be reduced. The techniques for tuning the electrical size of a chassis of a cellular phone include, for example, a chassis tuning element. Such an element is provided by means of a slot in the chassis, a chassis choke (also known as a wave trap), or a chassis loading element. A chassis tuning slot or a loading element can be used to increase the electrical length of the chassis in certain selected frequency band(s). A chassis choke can be used to shorten the electrical length of the chassis at some selected frequencies. The sole functionality of a chassis tuning element (CTE) has been the tuning of the electrical length of the chassis.

A common problem of the above described techniques to improve the antenna performance is that the implementation thereof requires space, either inside or outside the chassis. In small devices there may not be enough space available for implementing such chassis electrical size tuning elements.

The herein disclosed embodiments aim to address one or more of the above issues.

In accordance with an embodiment there is provided an antenna device for a portable electronic device, wherein the antenna device is configured to provide in a combination a tuning element for tuning at least one electrical dimension of the portable electronic device and an antenna radiator element of the portable electronic device.

Another embodiment provides a portable electronic device comprising such an antenna device.

A still another embodiment provides a method in a portable electronic device, the method comprising tuning at least one electrical dimension of the portable electronic device by a combined tuning and antenna radiator device and communicating radio signals via the tuned portable electronic device.

In a more specific embodiment, the tuning element is configured to tune at least one electrical dimension of a ground plane of the portable electronic device. The ground plane may comprise a printed wiring board and/or at least one layer of a multilayer printed wiring board. The ground plane may be embedded in a cover of the portable electronic device or may be provided as a part of the housing of the portable electronic device.

The tuning element may be configured to tune the at least one electrical dimension of the portable electronic device so that the resonance thereof is substantially optimal on at least one given frequency.

The antenna device may comprise at least one separator for separating the functions of the tuning element and the antenna radiator element. The at least one separator may comprise at least one of at least one filter and at least one radio frequency switch.

The tuning element may comprise at least one slot, least one wavetrap, at least one grounded microwave element, and/or at least one loading element.

The at least one electrical dimension may comprise at least one of an electrical length and electrical width.

The antenna device may comprise at least two chokes. The length and/or shape of the at least two chokes may be different. Lumped inductors with different inductor values may be provided within the at least two chokes.

Figure 3:
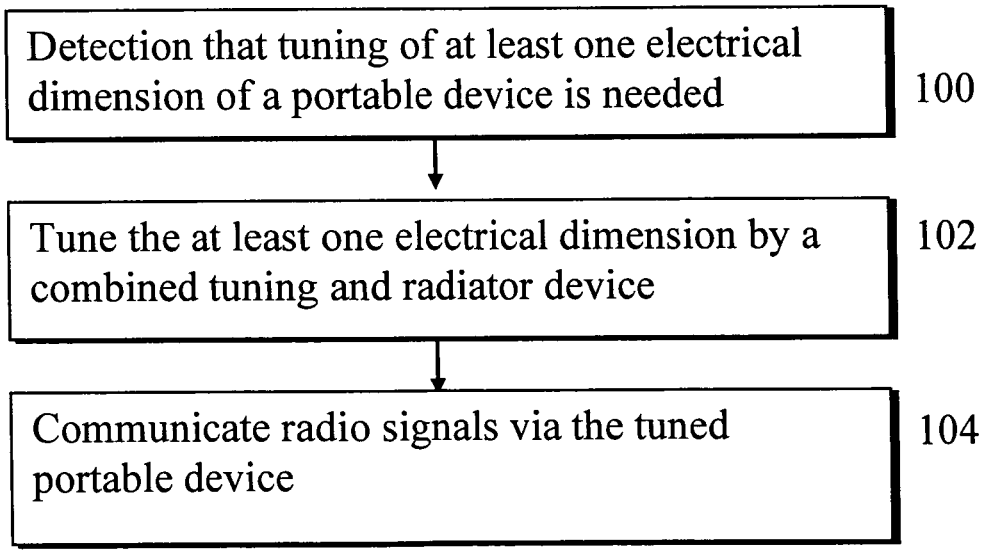
Figure 2A:
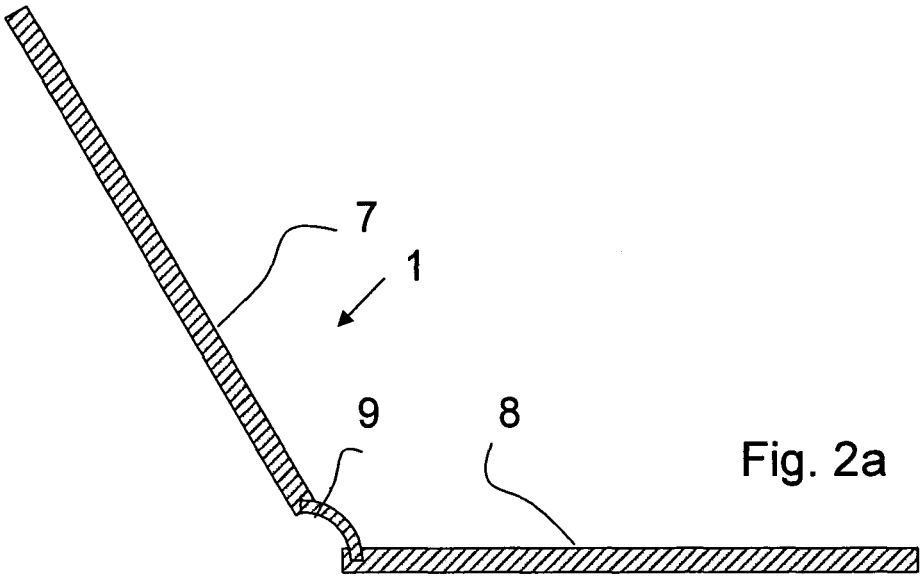
Figure 2B:
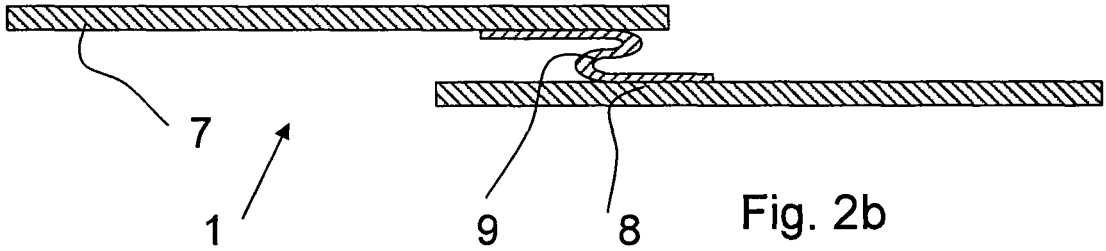

At least one shorting point may be provided for the tuning element and the antenna radiator element. Separate shorting points may be provided for the tuning element For a better understanding of the present invention and how the same may be carried into effect, reference will now be made by way of example only to the accompanying drawings in which:

FIGS. 1, 2*a* and 2*b* show examples of wireless communication devices;

FIG. 3 is a flowchart in accordance with an embodiment

Figure 4:
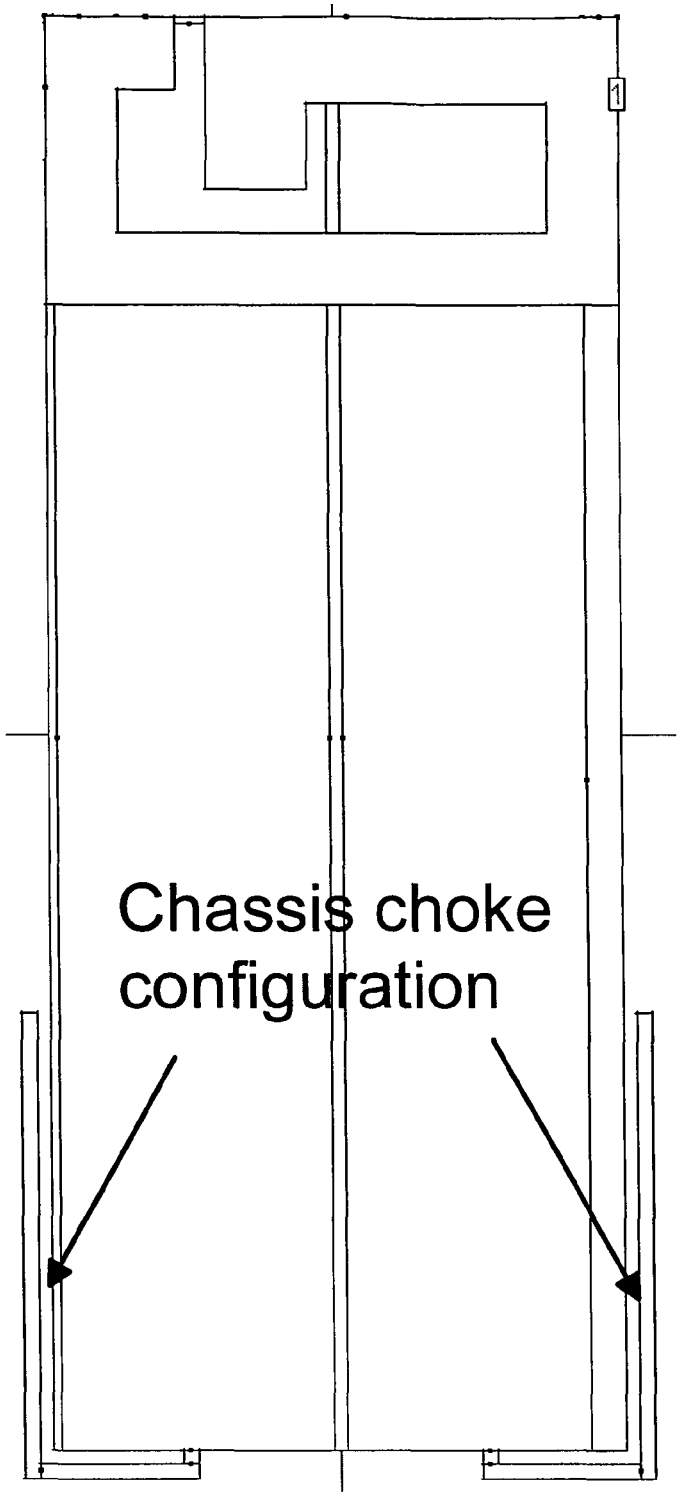
Figure 5:
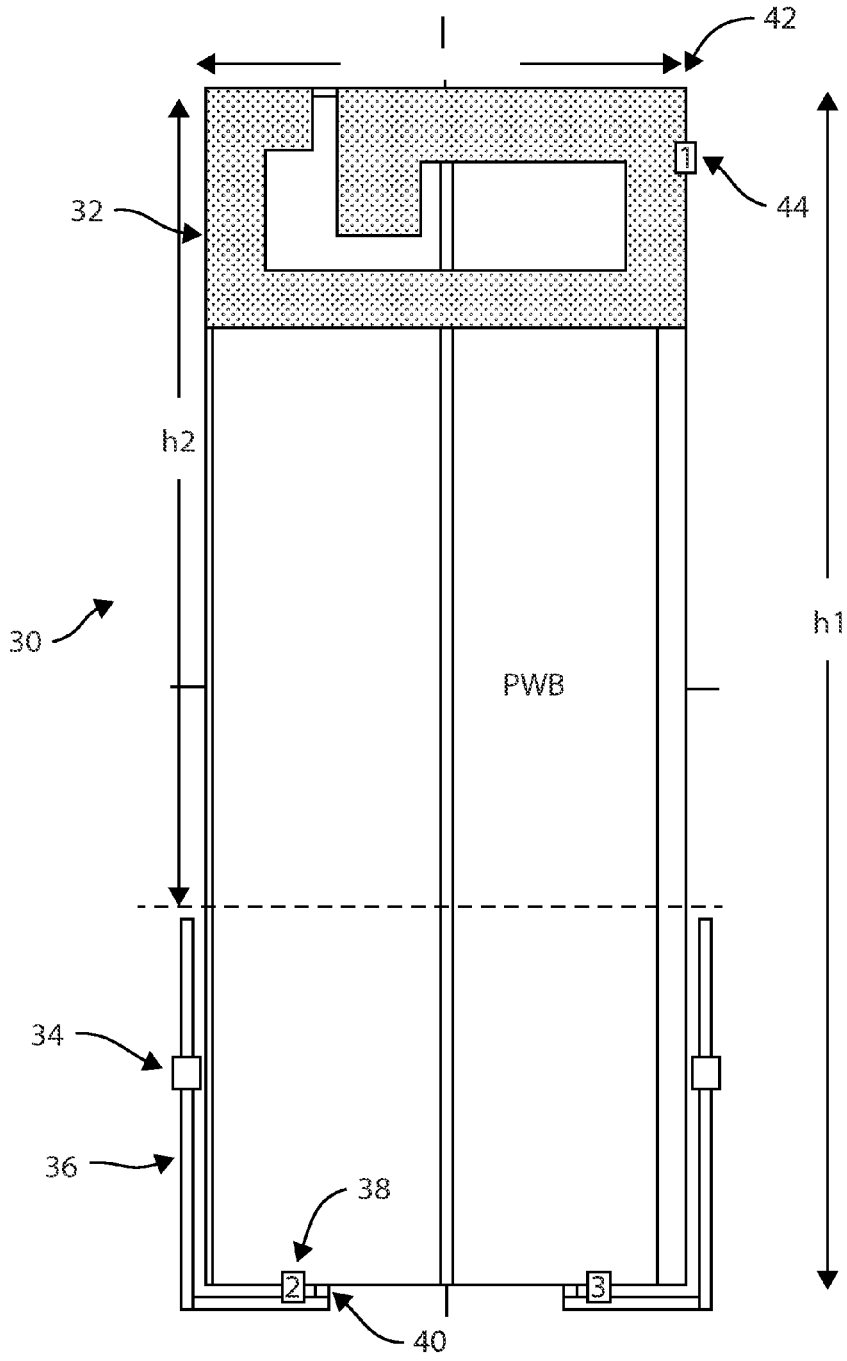
Figure 6:
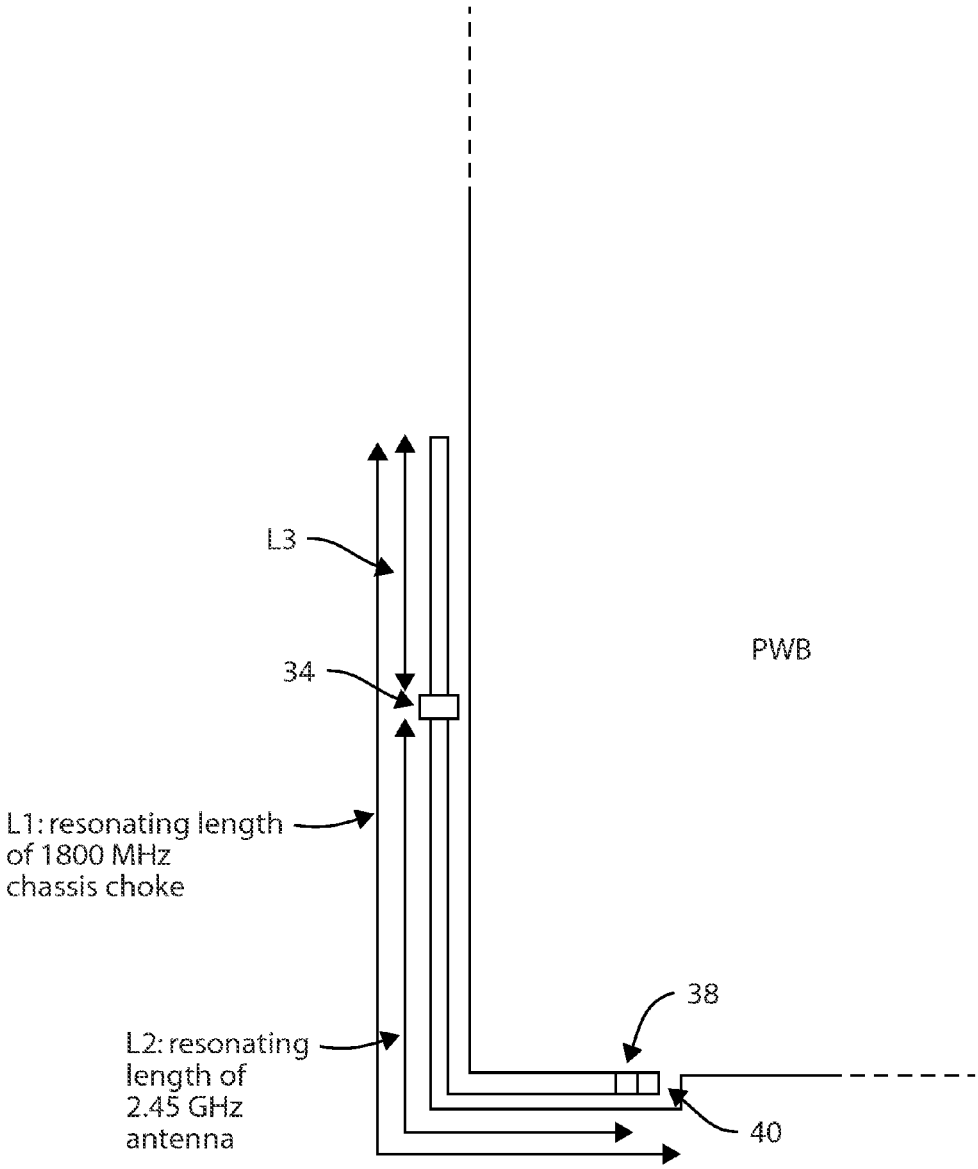
Figure 12:
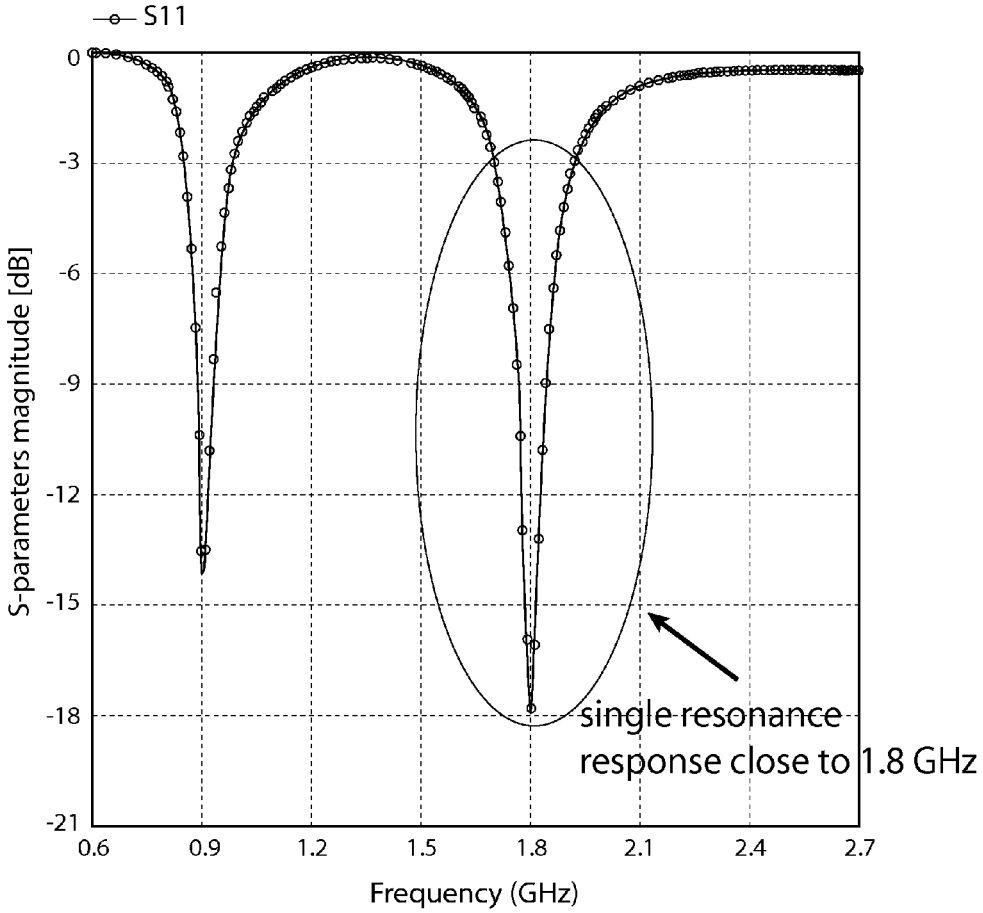
FIG. 12 PRIOR ART
Figure 13:
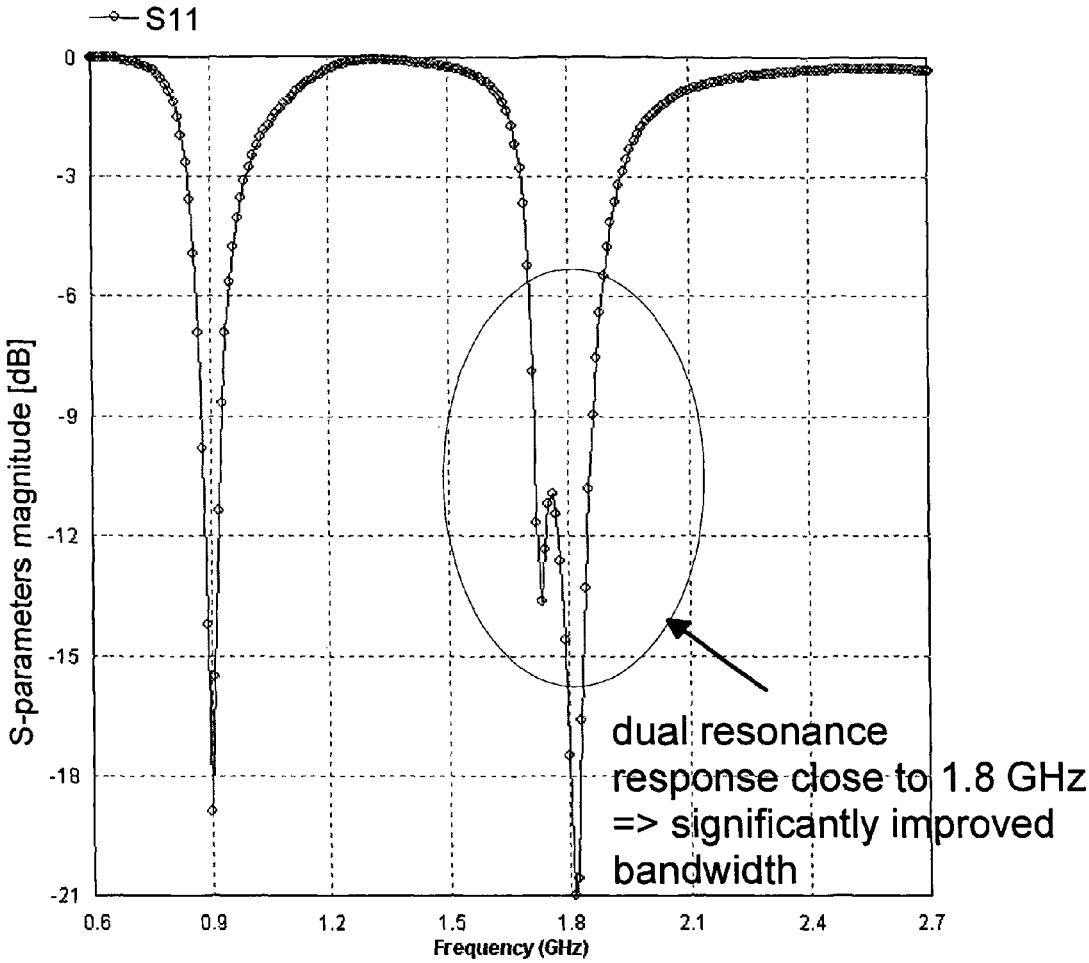
Figure 14:
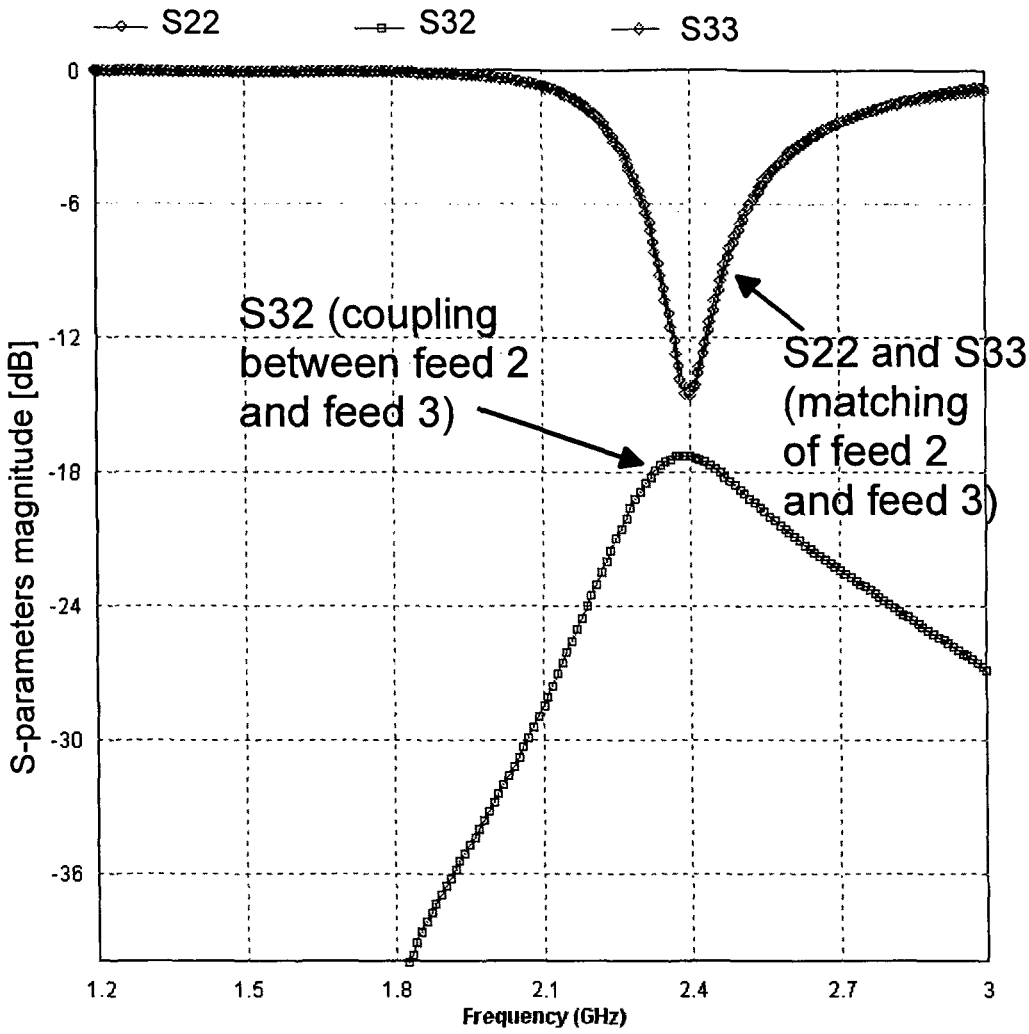

FIG. 4 presents an example of a tuning element;

FIG. 5 presents an example of a tuning element in accordance with an embodiment;

FIG. 6 presents a detail of the FIG. 5 device;

FIGS. 7 to 11 present further examples;

FIG. 12 presents an S-parameters magnitude curve for a conventional prior art antenna;

FIG. 13 presents an S-parameters magnitude curve for an antenna device in accordance with the embodiment shown in FIG. 5; and FIG. 14 presents an S-parameters magnitude curve for a high frequency band antenna; and Before explaining in detail certain exemplifying embodiments, certain general principles of wireless communication devices are briefly explained with reference to FIGS. 1, 2*a* and 2*b*. A portable communication device can be used for accessing various services and/or applications via a wireless or radio interface. A portable wireless device can typically communicate wirelessly via at least one base station or similar wireless transmitter and/or receiver node or directly with another communication device. A portable device may have one or more radio channels open at the same time and may have communication connections with more than one other parties. A portable communication device may be provided by any device capable of at least sending or receiving radio signals. Non-limiting examples include a mobile station (MS), a portable computer provided with a wireless interface card or other wireless interface facility, personal data assistant (PDA) provided with wireless communication capabilities, or any combinations of these or the like.

FIG. 1 shows a schematic partially sectioned view of a portable electronic device 1 that can be used for communication via at least one wireless interface. The electronic device 1 of FIG. 1 can be used for various tasks such as making and receiving phone calls, for receiving and sending data from and to a data network and for experiencing, for example, multimedia or other content. The device 1 may also communicate over short range radio links such as a Bluetooth™ link. The device 1 may communicate via an appropriate radio interface arrangement of the mobile device. The interface arrangement typically comprises an antenna radiator element. The antenna may be arranged internally or externally to the device. Possible antenna devices will be described in more detail later in this description.

A portable communication device is typically also provided with at least one data processing entity 3 and at least one memory 4 for use in tasks it is designed to perform. The data processing and storage entities can be provided on an appropriate circuit board and/or in chipsets. This feature is denoted by reference 6. The user may control the operation of the device 1 by means of a suitable user interface such as key pad 2, voice commands, touch sensitive screen or pad, combinations thereof or the like. A display 5, a speaker and a microphone are also typically provided. Furthermore, a wireless portable device may comprise appropriate connectors (either wired or wireless) to other devices and/or for connecting external accessories, for example hands-free equipment, thereto.

The device 1 may also be enabled to communicate on a number of different system and frequency bands. This capability is illustrated in FIG. 1 by the two wireless signals 11 and 21.

FIG. 1 shows a monoblock wireless device. FIGS. 2*a* and 2*b* show schematic examples of portable electronic devices where the length thereof can be varied. More particularly, FIG. 2*a* shows a foldable portable device 1 and FIG. 2*b* shows a portable electronic device 1 that is extendable between at least two lengths in a sliding or rotating fashion. As shown, the various sections 7 and 8 of the portable device 1 can be electrically connected at 9 regardless the state of extension thereof.

A portable communication device may be provided with a tuning element for tuning at least one electrical dimension of a portable electronic device. The electronic dimension may be the length and/or width of resonating element, a chassis or a ground plane of the electronic device.

In the examples shown in FIGS. 4 to 11 and described below the tuning element is referred by the term chassis tuning element (CTE). The chassis: tuning element may be provided e.g. by a wave trap, a chassis loading element, or a slot in the chassis. An example of the wave trap is a grounded microwave element. It is noted that although the term tuning element is used in here, this is intended to equally cover arrangements where no particular component is provided but the tuning element is provided for example by means of a slot.

Conventionally a basic function of a tuning element is to tune the electrical length of the chassis so that one or more of its resonance modes will move in frequency domain close to one or more of the operated frequency bands. For example, in a cellular device the tuning may be used to provide chassis resonance modes approximately in cellular bands such as 824-960 MHz or 1710-2170 MHz. Systems such as the WLAN or Bluetooth™ may require tuning on substantially higher frequency bands such as those around 2.45 GHz or 5 GHz.

In addition to this conventional functionality, the tuning element is used in the embodiments itself as an antenna radiator. This functionality may be provided both in a non-cellular system, such as the Bluetooth™ or wireless local area network (WLAN) and in cellular systems.

An example of the operation of such an antenna device is illustrated by the flowchart of FIG. 3. More particularly, in response to detection at 100 that tuning of resonance modes of a portable device is needed, at least one electrical dimension of a ground plane of the electronic device can be optimised at 102 by tuning function provided by a combined tuning and antenna radiator device. Radio signals can then be communicated after the tuning operation by the tuned electronic device at 104.

The dual functionality of a tuning element and a radiator device can be achieved by suitable design of the structure thereof. The sharing of the two functions can be achieved in a frequency domain. That is, the tuning element tunes the chassis electrical length into a different frequency band(s) than where it is used as a radiating antenna element. An appropriate separator such as a radio frequency (RF) filter can be used for achieving this, in situations where this is necessary. Alternatively, in certain applications the sharing of the functionality can also be done through multiplexing in the time domain with help of RF switches. The separator may also be a combination of a filter and a RF switch.

An example is now discussed in more detail with reference to FIGS. 4 to 6 where a possible combination of a chassis choke for a 1800 MHz cellular band and an antenna for WLAN 2.45 GHz system is shown. It is noted that the exemplifying dimensions and frequencies are only gives so as to ease the understanding of the invention and are not intended as limitations of any kind.

The antenna element for non-cellular wireless system may be provided by an inverted-F antenna (IFA) or a planar inverted-F antenna (PIFA), or any modifications thereof. It is noted that the examples given in this description are not limited to PIFA and IFA antenna types only. Instead, any other type of antennae may also be utilised.

The platform 30 where the combination of a chassis choke and an antenna is implemented may be, for example, provided by a h1=100 mm*l=40 mm chassis, having a dual-band (900/1800 Mhz) PIFA 32 (h=6 mm) at its one end. A RF feed 44 for 900/1800 MHz and a short circuit point 42 are provided at that part.

A combined 1.8 GHz chassis choke and 2.45 GHz antenna device 36 is also provide. The combined device 36 can be used to shorten the electrical length of the chassis down from the physical length h1=100 mm so that the effective electrical length thereof becomes approximately h2=70 mm. This length is close to an optimal chassis length for 1800 MHz.

A part of the tuning element structure may be separated from the original structure with an RF filter 34. This separated part is denoted by L3 in FIG. 6.

The needed low-pass or band-stop response can be implemented e.g. by an LC-circuit. The chassis choke may be a grounded or shorted quarter-wave metal strip at 1800 MHz. In practice the physical length thereof can be less than a quarter-wave. One end of the choke may be short-circuited at 40 to the chassis edge while its other end can be left open. The chassis choke may be bent around the chassis corner, to get the open end to the desired distance from the top of the chassis, as shown ein FIG. 5. The RF currents near the 1800 MHz frequency see a high impedance level on the edge of the chassis at around 70 mm distance from the top and are thus effectively choked. As a consequence, the RF currents at 1800 MHz see effectively about a 70 mm long chassis and this part of the chassis is in half-wave resonance at 1800 MHz since 70 mm is about $0.4\lambda_0$ at 1800 MHz. It is noted that similar effect can be provided by other mechanisms as well. For example, a N*quarter-wave long choke may be used, where N is an odd integer, may also be used.

The length of the full tuning structure is denoted by L1 in FIG. 6. Because of the filter, the RF currents at 2.45 GHz effectively are applied only to a part of the full structure that is before the filter 34. This length is denoted by L2 in FIG. 6. The length L2 is dimensioned so that it forms a resonance at around 2.45 GHz. An RF feed 38 of the 2.45 GHz transceiver system is positioned at an appropriate distance from the short-circuit point 40. Thus, effectively an Inverted-F Antenna (IFA) is formed for 2.45 GHz band.

If needed, the 2.45 GHz RF feed can be electrically separated from the structure at 1800 MHz band e.g. by another filter. The distance between the RF feed point and the short-circuit point can be configured such that a suitable impedance matching can be obtained for the 2.45 GHz system. The location of the short circuits can be common for both the chassis choke and the WLAN antenna functionality.

The suitable lengths of L1 and L2 for obtaining suitable resonances for choke operation and for antenna operation may also depend on the type of a filter that is used and the implementation thereof. For example, if an LC circuit is used for the filter, the lengths L1 and L2, and the values L and C can be adjusted to achieve suitable resonances for both functionalities.

A chassis choke configuration may include a pair of chassis chokes. One of the chokes may be provided on one edge of the chassis and the other symmetrically on the opposite edge. A wireless local area network (WLAN) antenna functionality can be implemented to only one or both of the chassis chokes. If the WLAN antenna functionality is implemented to both of them, they can be used as a diversity antenna system. Alternatively, an antenna radiator for some other band, such as 5 GHz band, can be implemented within the second choke.

Figure 7:
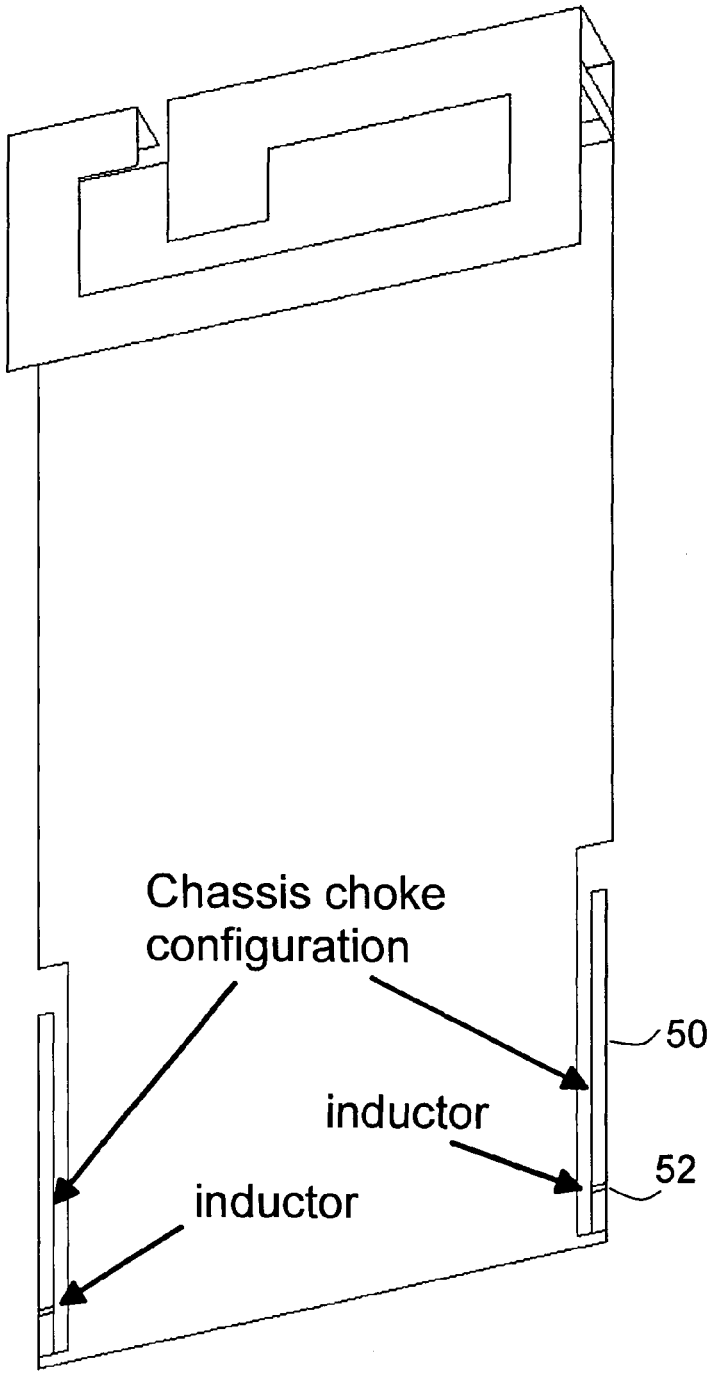
Figure 8:
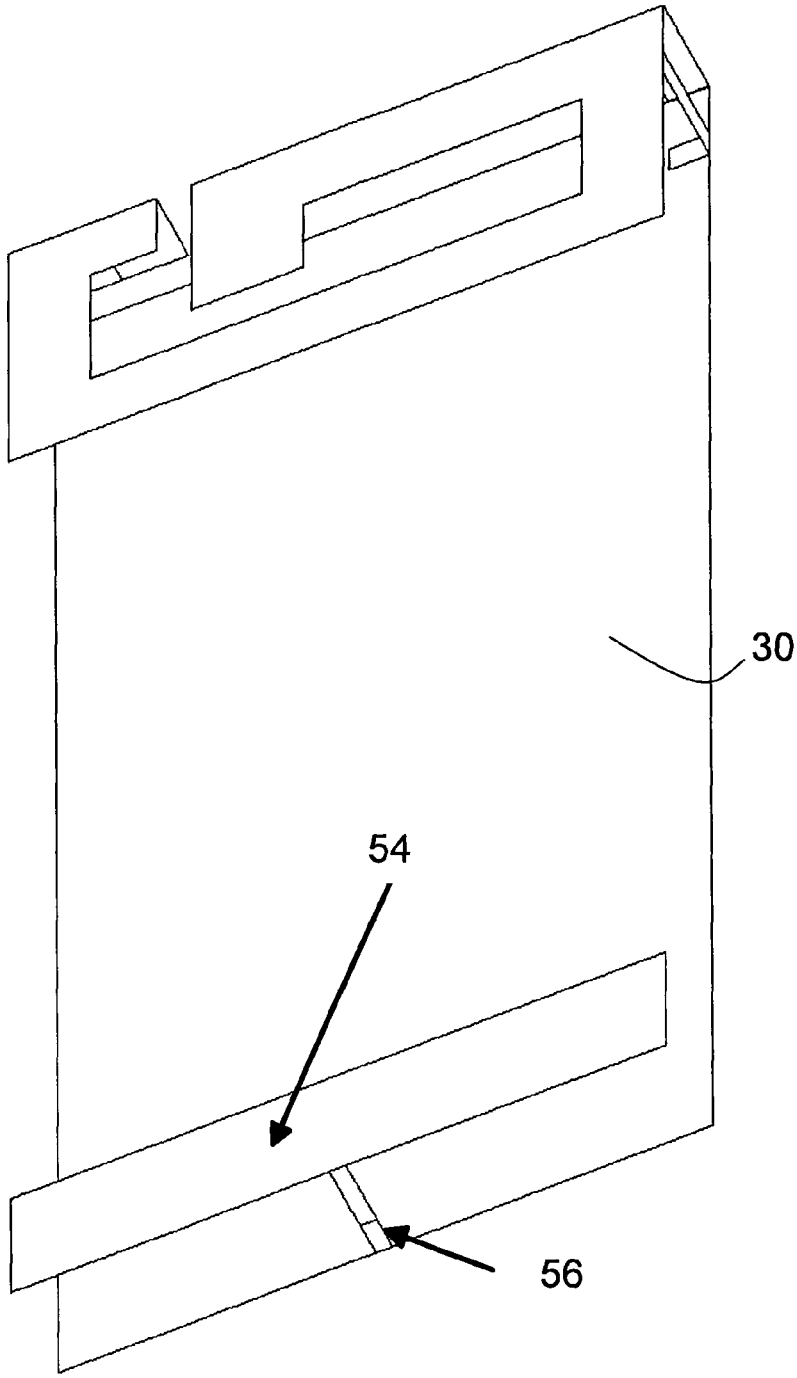

In an embodiment shown in FIG. 7 the physical length of a choke 50 can be decreased by integrating an inductor 52 of a suitable inductance value within the choke structure to increase the electrical length of the choke. For example, this can be provided by a lumped component or a PWB implemented inductor using a microstrip, a stripline or similar arrangement. Although the inductor is used in the choke to increase the electrical length of the choke, the choke itself is used to decrease the electrical length of the chassis. This provides a possibility to have a choke that may not need to be bent around a corner of the chassis. It is noted that similar effect can be provided by other mechanisms as well.

Furthermore, it is possible to implement a reconfigurable chassis choke configuration where a suitable inductor may automatically be selected from a few different inductors with help of an RF switch system. This enables a chassis choke of suitable length for different needs. For example, an appropriate choke can be provided for different frequency bands, different operational states in e.g. fold or sliding devices. This kind of reconfigurable chassis choke system may also be used as a chassis loading element at certain frequency band, if needed.

In a chassis choke configuration provided with two or more chokes, the length or the shape of the chokes may intentionally be designed differently. This may be used to further broaden the bandwidth. In an implementation where a lumped inductor is used within the chokes, different inductor values can be chosen in the design of the two chokes to give the same benefit.

A further example will now be described wherein a combination of a chassis loading element for 900 MHz cellular bands and an antenna radiator for a non cellular 2.45 GHz system is provided. The starting point platform can be the same as in the example above, i.e. a portable electronic device where one end of a for example 100 mm*40 mm chassis is provided with a dual band PIFA. At the other end there is a chassis loading element 54 that is connected to the chassis 30 through an inductor 56, see FIG. 8. The chassis loading element may be configured such that it functions as a passive element that increases the electrical length of the chassis or the electrical length of the ground plane in a desired frequency band. The purpose is, for example, to lower the first resonance of the 100 mm long chassis, to get it closer to the 824-960 MHz band.

Figure 9:
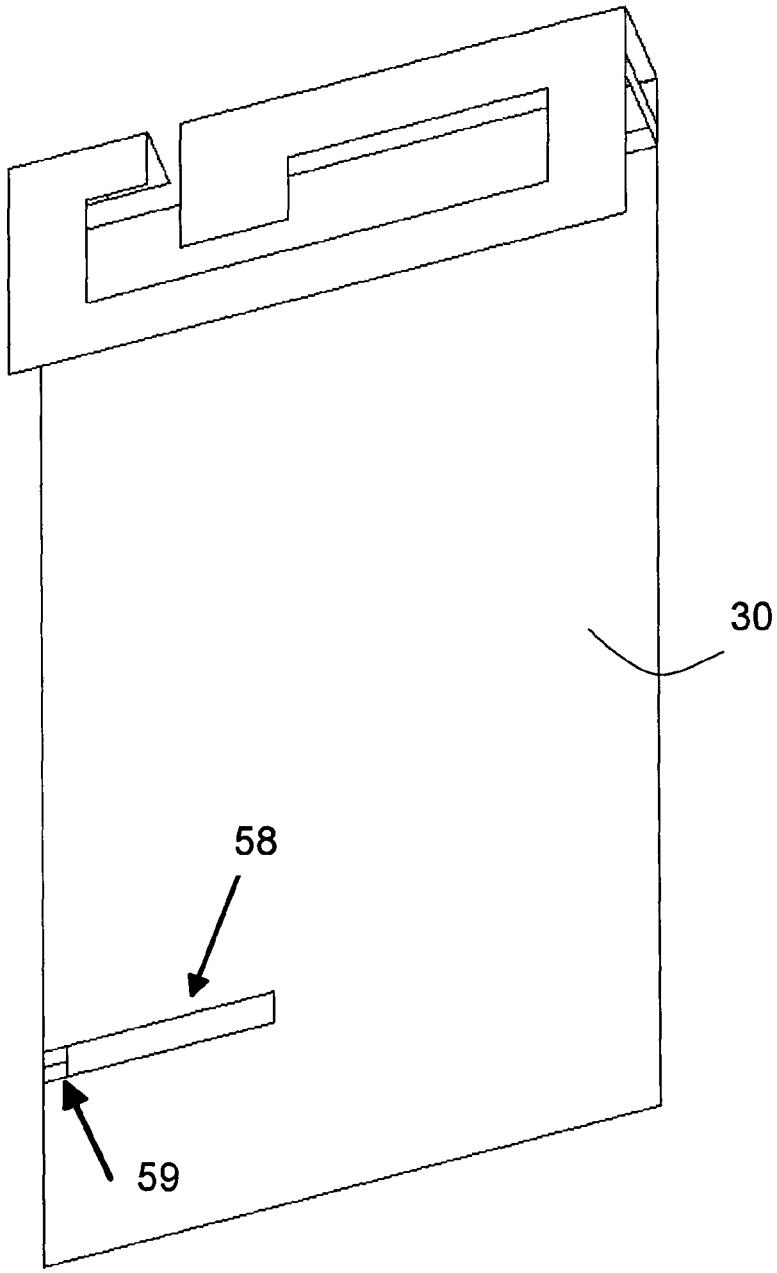

FIG. 9 shows a further example of a chassis tuning slot 58. A lumped element 59 such as an inductor or a capacitor, or a filter may be provided in the slot for separating the two sides of the slot.

Figure 10:
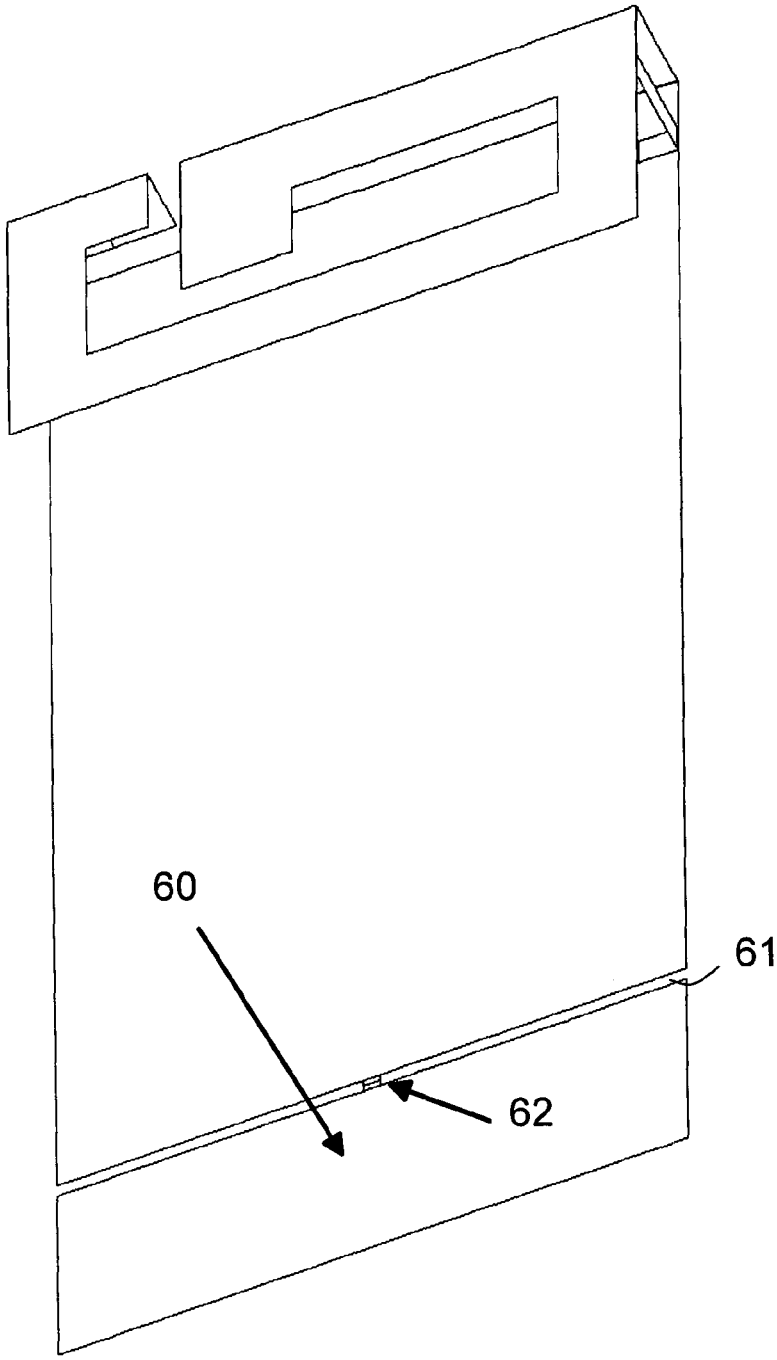

FIG. 10 shows an example of a chassis tuning or loading plate 60. An inductor, a capacitor, a filter or the like may be provided at 62 in the slot 61 for separating the chassis 30 and the chassis loading plate 60 (a segmented part of the chassis). A difference to the FIG. 8 example is that here a part of the ground plane is separated from the chassis to provide the loading plate.

A conventional version of the chassis loading element is passive, i.e. no RF feed is connected to it. In an advanced version an RF feed may be attached, for example for a 2.45 GHz system. One part of the loading element is separated from the main part of the structure with a filter so that a resonance can be achieved for 2.45 GHz antenna functionality.

In accordance with a further example a combination of a chassis loading element for 800-900 MHz cellular bands and an ultra wide band (UWB) monopole antenna for 6-8 GHz may be provided.

In accordance with a yet further example a combination of a chassis tuning slot for 800-900 MHz and 1800 MHz cellular bands and a slot antenna for 2.45 GHz system may be provided.

The above configuration may be designed by using a tuning element as the starting point of a design and add an antenna radiator functionality on top of it by a suitable design. The tuning element may operate in a lower frequency band than the desired antenna radiator functionality. In this case the dimensions of the original full structure of the tuning element do not need to be increased when adding the antenna functionality. It is also possible to design a configuration where the tuning element operates in a higher frequency band than the desired antenna radiator functionality.

The configuration can also be provided also other way around, i.e. the starting point can be an antenna radiator to which a tuning functionality is then added by means of a suitable configuration. In this case the primary functionality of the combined structure is the antenna radiator and the tuning functionality is an add-on functionality. Such approach can be employed in configuration examples as discussed below.

In accordance with an example a higher band cellular antenna is employed as a chassis tuning element for a lower band cellular antenna. In this example a low band (824-900 MHz) cellular antenna may be located at one end of a monoblock chassis. A high band (1700-2000 MHz bands) cellular antenna is located at the opposite end of the chassis. A switch (and possibly an additional switchable inductor) is incorporated into the feed structure of the high band cellular antenna so that it can also be used as a chassis loading element for increasing the electrical length of the chassis seen by the lower cellular bands. The low and high cellular bands are not used simultaneously so this kind of switching between the functionality as a high cellular bands antenna and a chassis tuning for low cellular bands is possible.

In accordance with another example a part of the structure of a large internal antenna of a cellular phone may be utilized as a chassis tuning element. For example, an internal antenna for frequency modulation (FM) or an internal antenna for DVB-H system can be employed as a chassis tuning element for an 800-900 MHz cellular band. An internal FM antenna may have a long radiator wire that is used as a receiving FM antenna element. A part of the FM antenna element structure may be separated with a suitable filter or switches and be utilized as a chassis tuning element e.g. for cellular 900 or 1800 MHz bands. The FM antenna element and the tuning functionality may be co-designed. For example, the radiator wire of the FM antenna element is routed inside the cellular phone plastic covers in such a way that a part of the wire can be advantageously utilized to increase the chassis electrical length seen by the cellular bands.

The above examples were presented in view of monoblock chassis. However, similar principles can be applied also for other mechanical forms of mobile devices such as the foldable and slideable devices shown in FIGS. 2*a* and 2*b*. Adaptive chassis tuning may be used in fold phones and slide phones, or generally in any portable device having multiple mechanical operation states. The device can be configured to detect the mechanical state it is, and then to tune the chassis length or other dimension differently. For example, a fold phone may be electrically too short when it is closed. At this state the electrical length can be increased, for example by any of the ways explained above. On the other hand, in the open state, the effective chassis may be too long. In this state it is appropriate to reduce the effective length.

In the examples above the antennas were implemented as self-resonating antennas. The examples were given with IFA and PIFA type of antennas. Some other resonating antennas such as microstrip loop antennas may also be used. The invention is not limited to self-resonant antennas but non-resonant coupling element type of antennas that are matched with a matching circuit can be used.

A tuning element can also be provided by means of a combination of any of the tuning elements discussed above, or utilize a chassis tuning technique not especially mentioned here.

A tuning element may be configured to tune at least one electrical dimension of a ground plane, for example, one of the dimensions, either length or width, of a printed wiring board (PWB). A printed wiring board is typically used to form the ground plane of the antenna system within a portable electronic device. The printed wiring board is typically utilised for several functions, one of which is to provide the ground plane for the antenna system by using some of the layers within a multilayer printed wiring board as solid copper etched metallic surfaces. These surface(s) usually cover the entire, or the majority, of the surface of at least one layer of a multilayer printed wiring board. This can be used to maximise the flow of current in the ground plane, which in turn maximises the performance of the antennae in most cases. The ground plane may also provide a key radiating element within the antenna system.

In addition of being provided as a separate component, the ground plane may also be embedded in a cover of a portable electronic device or may be provided to form a part of the housing of the portable electronic device.

One implementation of the antenna functionality of a tuning element could be such that the feeding RF signal to (or from) the tuning element, when it is used as a radiating antenna element, is coupled non-galvanically e.g. by aperture-coupling techniques.

Another possible implementation is where the tuning element is used as a parasitic radiator for a nearby antenna. In this application the tuning element primary function is to tune the chassis electrical length in a frequency band A. Its secondary function is to act as a parasitic radiator in a frequency band B. In this case no RF feed line is connected to the tuning element but an RF feed is connected to a nearby, driven antenna. The parasitic radiator function of the tuning element then increases the bandwidth of the nearby antenna at some desired frequency band.

It is noted that the term antenna radiator used in this document may refer to an antenna element either for a transmitter system, or a receiver system, or a transceiver system. Accordingly, a radio frequency (RF) feed may refer to an input port of a transmitting system, an output of a receiver RF system, or a input/output of a transceiver RF system.

A tuning element utilized in this invention may be applied to tune not only the electrical length but more generally the electrical dimensions of the chassis. Thus, in addition, or alternatively, some other geometrical dimension of the chassis, in particular the width may be tuned. Considering these two dimensions, the electrical length of the chassis usually dictates the longitudinal resonance modes and the electrical width usually dictates the transversal resonance modes. The electrical width may be tuned in order to utilize the transversal modes as well. For example, in a "curved" chassis, there can be both longitudinal and transversal resonance modes, or combinations of them.

The tuning element functionality of the structure can be configured to operate in a single or multiple frequency bands. A multiband tuning element can tune the electrical size of the chassis optimally for several frequency bands simultaneously. In addition, the antenna functionality of the structure can be designed to operate in one or multiple frequency bands.

Figure 11:
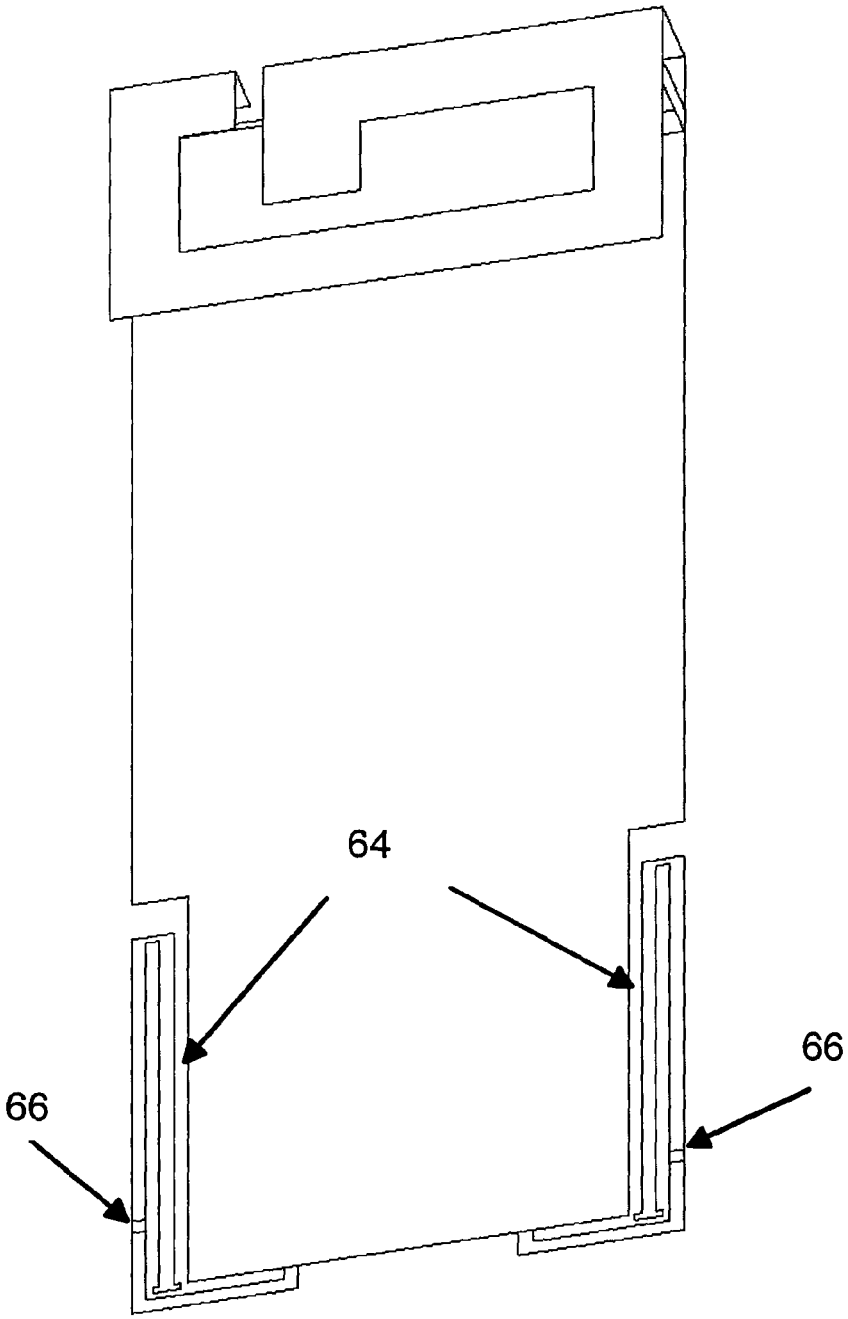

For example, a chassis choke may be provided that can be itself operate as a choke in two different frequency bands. A dual-band choke configuration 64 that can be used as a chassis choke in certain embodiments is shown in FIG. 11. The configuration may be provided with inductors 66.

In a typical use scenario a tuning element can be used to tune the electrical size of the chassis optimally for cellular bands. In other implementations a tuning element may be used to tune the chassis resonance modes optimally for a non-cellular frequency band(s) and be used itself as an antenna radiator in cellular bands.

A multiradio antenna system of a mobile terminal may include several combined tuning and antenna radiator elements, which are co-designed. This way, optimal utilization of antenna and chassis tuning functionalities could be achieved for several frequency bands and radio systems.

It is also possible to implement two separate shorting points, or ground connections, one for the choke and one for the antenna functionality. Although one shorting point is enough in certain applications, it may be useful to have two, or more, in some other applications.

The performance of some of the embodiments has been tested. To ease the comparison with a single function antenna radiator, an antenna element with a 900/1800 MHz PIFA on an untuned 100 mm*40 mm chassis and its S-parameters magnitude response are shown in FIG. 12.

As a background for understanding the results shown in FIGS. 12 to 14, the S11 response is a measure of the quality of impedance match seen at the feed to an antenna or RF circuit under test. Ideally one would want to transfer 100% of the source power to the antenna or RF circuit. However, due to discontinuities, stray inductances and stray capacitances in the physical structures associated with the physical implementation of the device and it's associated components, 100% power transfer is only rarely achieved. This is also termed as Return Loss, measured in dB (decibels). In the test, a RF signal (source) across a range of frequencies is applied to the antenna or RF circuit under test (load), at a set power level, and the amount of signal (power) received back from the load is expressed as a power ratio, when compared with the source power. The power received back is typically referred to as reflected power. When there is a large return loss (dB) then there is said to be a "good match" over a given band of frequencies. For example, if there is a 10 dB return loss then 90% of the applied signal is transferred to the device, 10% is reflected, this being an "excellent match". If there is a 6 dB return loss then 75% of the applied signal is transferred to the device, 25% is returned to the source. If there is a 3 dB return loss then 50% of the power would be transferred and 50% reflected. And as a final example, if there is a 1 dB return loss then only 25% of the power would be transferred and 75% reflected, hence a "poor match". From this test it is also possible to see where, for example, an antenna is resonant.

From FIG. 12 it can be seen that at 1800 MHz band there is only one resonance response. This originates from the 1800 MHz branch of the planar inverted-F antenna (PIFA) element.

FIG. 13 illustrates the effects of introduction of a chassis choke. As can be seen, this leads to the first effective half-wave resonance of the chassis advantageously move close to 1800 MHz. Effectively, this leads to a dual resonant response of S11. In FIG. 13 diagram the first resonance originates from the PIFA and the second resonance originates from the tuned chassis. It is noted that this example is based on a relatively rough optimisation, and that with more optimisation of the resonance couplings better results might be expected. Nevertheless, it can be seen that the use of a combined tuning and radiator element clearly improves the bandwidth of the device.

If so desired, the tuning element of this example can also be operated as a WLAN 2.45 GHz antenna with a sufficient bandwidth. This is shown in FIG. 14.

The exemplifying embodiments described how an additional functionality may be integrated to an electrical size tuning element of a communication device. This may result in effects such as savings in space and cost. In a particular embodiment, a functionality of one or more non-cellular antenna radiator element(s) is combined within a chassis tuning element. This may be advantageous in antenna designs for multiradio and other communication devices. For example, reuse of a chassis electrical size tuning element e.g. as a non-cellular antenna may reduce the total volume of a multiradio antenna system. This may help in reducing the total volume of the overall product. Also, as there are only a limited number of suitable locations for antennas and tuning elements in a mobile terminal, a more optimal use of these locations can be achieved by combining an antenna with a chassis electrical length tuning element. There might not even be enough space for implementing a chassis tuning element, if it is not integrated with some other functionality. As a result of the present invention, better exploitation of mobile terminal chassis resonance modes and their control techniques can be achieved.

It is noted that whilst embodiments have been described in relation to wireless communication devices such as mobile terminals, embodiments of the present invention are applicable to any other suitable type of apparatus suitable for communication via a wireless interface. It is also noted that although certain embodiments were described above by way of example with reference to the exemplifying standards, cellular networks and wireless local area networks, embodiments may be applied to any other suitable forms of wireless interfaces than those illustrated and described herein. It is also noted that the term wireless is understood to refer to any radio interface that an apparatus configured for wireless communication may use.

It is also noted herein that while the above describes exemplifying embodiments of the invention, there are several variations and modifications which may be made to the disclosed solution without departing from the scope of the present invention as defined in the appended claims.

The invention claimed is:

1. An antenna device for a portable electronic device configured to provide in a combination a tuning element for tuning at least one electrical dimension of the portable electronic device and an antenna radiator element of the portable electronic device.

2. An antenna device as claimed in claim 1, wherein the tuning element is configured to tune at least one electrical dimension of a ground plane of the portable electronic device.

3. An antenna device as claimed in claim 1, wherein the ground plane comprises a printed wiring board.

4. An antenna device as claimed in claim 1, wherein the ground plane is embedded in at least one of a cover of the portable electronic device or is provided as a part of the housing of the portable electronic device.

5. An antenna device as claimed in claim 1, wherein the tuning element is configured to tune the at least one electrical dimension of the portable electronic device so that the resonance thereof is substantially optimal on at least one given frequency.

6. An antenna device as claimed in claim 1, comprising at least one separator for separating the functions of the tuning element and the antenna radiator element.

7. An antenna device as claimed in claim 6, wherein the at least one separator comprises at least one of at least one filter and at least one radio frequency switch.

8. An antenna device as claimed in claim 1, wherein the tuning element comprises at least one of a slot, wavetrap, grounded microwave element or loading element.

9. An antenna device as claimed in claim 1, wherein the at least one electrical dimension comprises at least one of an electrical length and electrical width.

10. An antenna device as claimed in claim 1, wherein the at least one electrical dimension comprises at least one dimension of at least one of a chassis, a ground plane and printed wiring board of the portable device.

11. An antenna device as claimed in claim 1, wherein the tuning element is configured to change an electrical dimension of the portable electronic device.

12. An antenna device as claimed in claim 1, wherein the tuning element and the antenna radiator element operate on different frequency bands.

13. An antenna device as claimed in claim 1, comprising at least two chokes.

14. An antenna device as claimed in claim 13, wherein at least one of the length or shape of the at least two chokes is different.

15. An antenna device as claimed in claim 13, comprising lumped inductors with different inductor values within the at least two chokes.

16. A portable electronic device comprising an antenna device configured to provide in a combination a tuning element for tuning at least one electrical dimension of a ground plane of the portable electronic device and an antenna radiator element of the portable electronic device.

17. Portable electronic device as claimed in claim 16, wherein the portable electronic device is configured to detect operational state thereof and the antenna device is configured to be responsive to a detected operational state.

18. A method in a portable electronic device, comprising tuning at least one electrical dimension of the portable electronic device by a combined tuning and antenna radiator device; and communicating radio signals via the tuned portable electronic device.

19. A method as claimed in claim 18, comprising tuning the at least one electrical dimension of the portable electronic device so that the resonance thereof is substantially optimal on at least one given frequency.

20. A method as claimed in claim 18, comprising changing an electrical dimension of the portable electronic device.

* * * * *